US007109833B1

(12) United States Patent
Pohl

(10) Patent No.: US 7,109,833 B1
(45) Date of Patent: Sep. 19, 2006

(54) TERMINAL BLOCK TIME DELAY RELAY

(75) Inventor: Randy P. Pohl, East Troy, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 11/193,778

(22) Filed: Jul. 29, 2005

(51) Int. Cl.
*H01H 43/00* (2006.01)

(52) U.S. Cl. ..... 335/59; 335/67; 361/626; 361/636; 361/673; 361/819

(58) Field of Classification Search ..... 361/195–202, 361/626, 634–636, 673, 819, 823, 837; 335/59, 335/60, 67, 78, 202
See application file for complete search history.

(56) References Cited

U.S. PATENT DOCUMENTS 3,809,965 A * 5/1974 Groth et al. ..... 361/819
3,824,434 A * 7/1974 Boley et al. ..... 361/142
5,740,002 A * 4/1998 Jenss et al. ..... 361/93.9
5,786,987 A * 7/1998 Barbier et al. ..... 361/732
6,648,692 B1 11/2003 Gillrath et al.
6,940,021 B1 * 9/2005 Pohl et al. ..... 174/137 R
2003/0063418 A1 * 4/2003 Bergh et al. ..... 361/51
2004/0087215 A1 5/2004 Pohl et al.

OTHER PUBLICATIONS

Allen Bradley Bulletin 700-FE, DIN Rail Timing Relays, pp. 107-111, admitted prior art.
Allen Bradley Bulletin 700-HNC, Plug-in Timing Relays, pp. 134-141, admitted prior art.
Allen Bradley Bulletin 700-HT3, Time Module Installation 2-Sided Instruction Sheet, 2 pp., dated 2003.

* cited by examiner

*Primary Examiner*—Ramon M. Barrera
(74) *Attorney, Agent, or Firm*—Keith M. Baxter; Alexander M. Gerasimow

(57) ABSTRACT

A terminal block time delay relay includes a terminal block, a plurality of terminals, a first timing control, and a timing circuit. The terminal block defines a socket operable to receive an electrical relay. The plurality of terminals are accessible at edges of the terminal block. The first timing control is supported by the terminal block. The timing circuit is housed by the terminal block and coupled to the terminals, the first timing control, and the socket.

22 Claims, 1 Drawing Sheet

TERMINAL BLOCK TIME DELAY RELAY

CROSS-REFERENCE TO RELATED APPLICATIONS

Not applicable.

STATEMENT REGARDING FEDERALLY SPONSORED RESEARCH OR DEVELOPMENT

Not applicable

BACKGROUND OF THE INVENTION

The present invention relates generally to narrow-profile, terminal block relays, and in particular, to a terminal block time delay relay.

This section of this document is intended to introduce various aspects of art that may be related to various aspects of the present invention described and/or claimed below. This section provides background information to facilitate a better understanding of the various aspects of the present invention. It should be understood that the statements in this section of this document are to be read in this light, and not as admissions of prior art.

"European style" terminal blocks provide a method of electrical interconnection of industrial control components. These terminal blocks have a narrow and flat shape that allows them to be stacked together in close proximity when mounted on a DIN rail. When so stacked, wires may be received at terminals along the upper and lower edge of the terminal blocks.

The terminals allow connection to other wires connected to other terminals or to the leads of electrical components supported by the terminal block. Such electrical components may include fuses, indicator lights, and relays.

For a terminal block holding a relay ("a terminal block relay"), a replaceable relay is typically received by a socket at the front edge of the terminal block. The housings holding the relay or fuse are designed to have a width no greater than that of the terminal block, typically between 5 to 14 mm, to minimize space occupied on the DIN rail.

Programmable logic controllers (PLCs) are industrial computers used for the control of machines and processes. A PLC has input and output circuits that may connect to sensors and actuators on controlled machines and by executing a standard control language, such as relay ladder language, the PLC may read the inputs and according to the execution of the control program and provide outputs controlling the machine.

Terminal block relays are often used with a PLC, the latter which may be attached to the same DIN mounting rail on which the terminal block relays are mounted. Outputs from the PLC are connected to the coils of terminal block relays whose outputs in turn connect to the desired machine actuator to provide a form of isolation.

One particular type of relay useful in industrial control applications is a time delay relay. Time delay relays have various modes of operation, but generally, the activation or deactivation of the relay is delayed by predetermined time interval. Typically, time delay relays in narrow profile applications include a single package that holds the timing circuitry, the coil, and the outputs.

A time delay relay typically has a plurality of settings, including delay mode, range, and delay. Adjustment dials are provided on the time delay relay for altering these settings. Due to the need for providing access to the adjustment dials, terminal blocks for time delay relays are typically larger than their standard relay counterparts, thereby consuming more panel space within the control cabinet.

In a time delay relay, the components typically prone to usage-related failure are the coil and switching device. Because the timing circuitry is integrated with the relay circuitry (e.g., coil, switch, and outputs), the entire time delay relay must be replaced due to the failure of the moving parts of the relay circuitry. The settings of the replacement relay must then be reconfigured to provide the proper mode, range, and delay setting.

BRIEF SUMMARY OF THE INVENTION

The present inventor has recognized that a narrow profile terminal block time delay relay may be configured with timing circuitry housed by the terminal block and a replaceable socket based relay to allow a more compact relay size and decreased maintenance costs.

One aspect of the present invention is seen in a terminal block time delay relay including a terminal block, a plurality of terminals, a first timing control, and a timing circuit. The terminal block defines a socket operable to receive an electrical relay. The plurality of terminals are accessible at edges of the terminal block. The first timing control is supported by the terminal block. The timing circuit is housed by the terminal block and coupled to the terminals, the first timing control, and the socket.

Another aspect of the present invention is seen in a terminal block time delay relay including a terminal block, an electrical relay, a plurality of terminals, a delay control, a timing control, and a timing circuit. The terminal block defines a socket. The electrical relay is mounted in the socket. The plurality of terminals are accessible at edges of the terminal block. The delay control is supported by the terminal block and accessible at one of the edges. The timing control is supported by the terminal block and accessible at a side face of the terminal block. The timing circuit is housed by the terminal block and coupled to the terminals, the delay control, the timing control, and the socket.

These and other objects, advantages and aspects of the invention will become apparent from the following description. The particular objects and advantages described herein may apply to only some embodiments falling within the claims and thus do not define the scope of the invention. In the description, reference is made to the accompanying drawings which form a part hereof, and in which there is shown a preferred embodiment of the invention. Such embodiment does not necessarily represent the full scope of the invention and reference is made, therefore, to the claims herein for interpreting the scope of the invention.

BRIEF DESCRIPTION OF THE SEVERAL VIEWS OF THE DRAWINGS

The invention will hereafter be described with reference to the accompanying drawings, wherein like reference numerals denote like elements, and.

Figure 1:
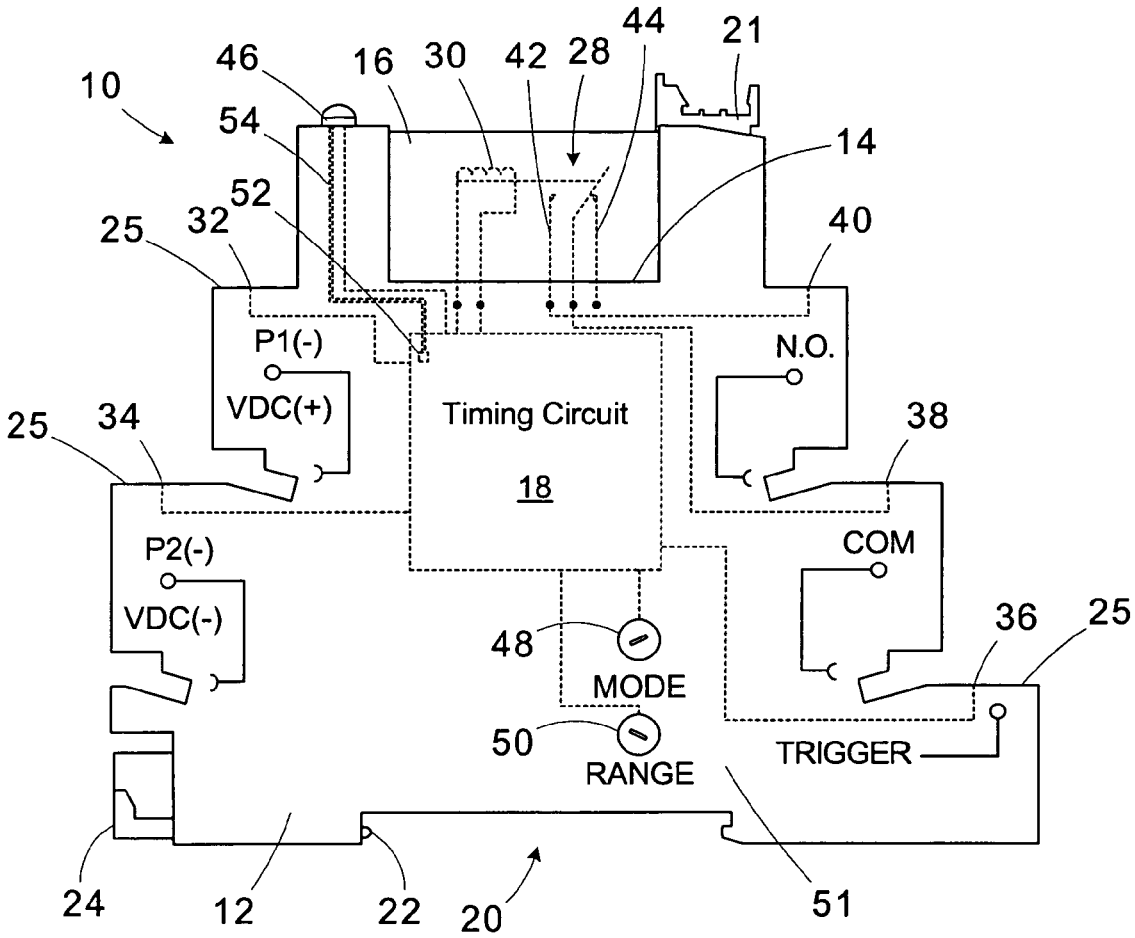
FIG. 1 is a side view of a terminal block time delay relay in accordance with one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

One or more specific embodiments of the present invention will be described below. It is specifically intended that the present invention not be limited to the embodiments and illustrations contained herein, but include modified forms of those embodiments including portions of the embodiments and combinations of elements of different embodiments as come within the scope of the following claims. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the present invention unless explicitly indicated as being "critical" or "essential."

Referring now to the drawings wherein like reference numbers correspond to similar components throughout the several views and, specifically, referring to FIG. 1, the present invention shall be described in the context of a terminal block time delay relay 10. The terminal block time delay relay 10 includes a terminal block 12, defining a socket 14 for receiving a narrow profile electrical relay 16 (e.g., electromechanical or solid state). The terminal block 12 houses a timing circuit 18 (e.g., a printed circuit board) and electrical conductors for coupling the electrical relay 16, timing circuit 18, and the various terminals of the terminal block time delay relay 10 detailed below. The terminal block 12 defines a channel 20 for interfacing the terminal block time delay relay 10 with a mounting rail (not shown), commonly referred to as a DIN rail. A tab 21 is provided for locking the electrical relay 16 into the socket 14 and for assisting in the removal of the electrical relay 16 from the socket 14.

The sides of the terminal block time delay relay 10 are substantially planar so as to abut corresponding left or right sides of other similar terminal blocks that may also be placed on a DIN rail and stacked together against the terminal block time delay relay 10 with no wasted space. The terminal block time delay relay 10 may be releasably retained on a DIN rail positioned within the channel 20 by operation of a catch 22 retractable by a slide 24.

Figure 2:
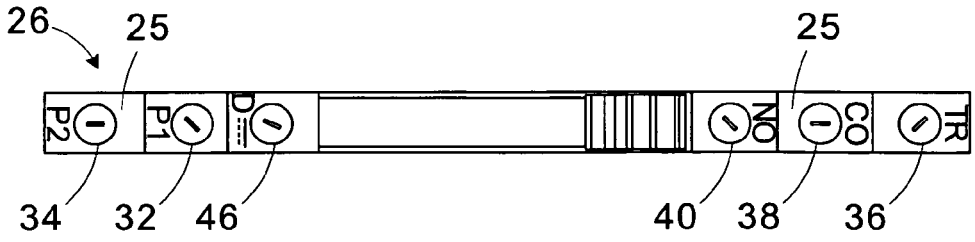
FIG. 2 is a top view of the terminal block time delay relay of FIG. 1.

Referring to FIG. 2, edges 25 of the terminal block time delay relay 10 support terminals 26, such as screw terminals or screw-less terminals, for receiving and electrically connecting to wires in the control cabinet, free from interference from adjacent terminal blocks. The sides of the electrical relay 16 are coplanar with corresponding sides of the terminal block 12 and its top edge is flush with the top edge of the terminal block 12, the electrical relay 16 may be removed from the terminal block time delay relay 10 for repair or replacement without disturbing the terminal block 12 or modifying its timing settings. Electrical relays 16 suitable for use in the present invention are commercially available from a variety of vendors including the Allen-Bradley brand offered by Rockwell Automation, Inc. of Milwaukee, Wis.

As is understood in the art, the contacts 28 and coil 30 of the electrical relay 16 are connected through the socket 14 to the various ones of the terminals 26 via conductors (shown in phantom) internal to the terminal block 12. The terminal block 12 thus provides a simple method of connecting to the electrical relay 16 mechanically and electrically. Alternatively, a solid state relay may be used that does not have actual coils or contacts, but rather has outputs and inputs and performs the same functionality as a electromechanical relay. The term electrical relay is intended to include electromechanical and solid state relays.

As seen in FIG. 2, the terminals 26 include power supply terminals 32, 34 ("P1" and "P2"), a trigger terminal 36 ("TR"), a common output terminal 38 ("CO"), and a normally-open output terminal 40 ("NO"). In the illustrated embodiment, the terminal block time delay relay 10 is a normally-open relay. Accordingly, the normally-open output terminal 40 is coupled to the corresponding normally-open output 42 of the electrical relay 16 in the socket 14, as depicted in FIG. 1. However, a normally-closed implementation may be realized by simply connecting to the normally-closed output 44 in the electrical relay 16 through the socket 14. The terminal block time delay relay 10 may also provide both normally-open and normally-closed terminals by connecting to both outputs 42, 44 and adding another terminal 26.

Referring back to FIG. 1, the terminal block time delay relay 10 includes a plurality of controls, such as a delay control 46, a mode control 48, and a range control 50. These controls 46, 48, 50 are received by the timing circuit 18 to define the operating parameters of the terminal block time delay relay 10. The construct and operation of the timing circuit 18 are well known to those of ordinary skill in the art, so for ease of illustration and to avoid obscuring the present invention, they are not described in detail herein.

In general, the mode control 48 is a multi-position selector switch that sets the mode of the terminal block time delay relay 10. In the various modes, the type of delay and its associated trigger may vary. Table 1 below illustrates exemplary modes for the terminal block time delay relay 10.

TABLE 1

| Delay Modes | |
|---|---|
| TIMING MODE | TRIGGER |
| ON-DELAY | POWER-ON |
| OFF-DELAY | TRIGGER SIGNAL |
| ONE-SHOT | POWER-ON |
| REPEAT CYCLE | POWER-ON |
| FLEETING OFF DELAY | TRIGGER SIGNAL |
| PULSE CONVERTER | TRIGGER SIGNAL |

In some modes, the trigger for the delay is provided by an input signal received at the trigger terminal 36. Other modes do not include an external trigger. For example, the triggering event may be the application or removal of power on the power terminals 32, 34. Accordingly, the trigger terminal 36 is optional, and may not be present if the terminal block time delay relay 10 is not required to support externally triggered modes.

The range control 50 sets the range for the delay interval. For example, the delay interval may range from 0 to 10 seconds, 0–100 seconds, 0–10 minutes, etc. Changing the position of the range control 50 sets the upper limit of the delay interval range. The delay control 46 allows the fine-tuning of the delay interval within the range specified by the range control 50. Hence, if the range control sets a delay interval range of 0 to 10 seconds, the delay control 46 may be tuned to set the delay interval to 7 seconds, for example. Typically, the delay control 46 and range control 50 are provided using potentiometers that may be rotated using a tool, such as a screwdriver, to set their appropriate values.

In the illustrated embodiment, the delay control 46 is disposed on an edge of the terminal block 12 and is normally accessible when the terminal block time delay relay 10 is installed adjacent other terminal block relays. The mode control 48 and range control 50 are disposed on a side face 51 of the terminal block, which is not normally accessible after the terminal block time delay relay 10 is installed adjacent other terminal block relays. Typically, the mode control 48 and range control 50 do not require adjustment after installation. Timing tuning is normally conducted using the delay control 46. Because the mode control 48 and range control 50 are not readily acceptable, the likelihood of an inadvertent adjustment is decreased.

In the illustrated embodiment, the delay control 46 is transparent or translucent such that it allows the passage of light. Hence, the delay control 46 may act as both a control device and an indicating device without increasing the package size. A light engine 52, such as a light emitting diode (LED), may be included in the timing circuit 18, and a light pipe 54, such as a fiber optic line or other light guide, may communicate optically between the light engine 52 and the delay control 46. Of course, other implementations, such an LED integrated into the delay control 46 may be used. The status information provided by the illumination of the delay control 46 may vary. In one embodiment, the delay control 46 may be lit to indicate that power is applied to the power terminals 32, 34. The delay control 46 may flash during a delay event (i.e., when the timing circuit 18 is counting down a delay interval after a triggering event).

The terminal block time delay relay 10 of the present invention has numerous advantages. The socket 14 allows the use of a replaceable relay module 16, thereby simplifying maintenance. The relay module 16 is the part most likely to wear out over time. The relay module 16 may be readily replaced without having to adjust the timing settings or without having to remove and reconnect electrical wires. The arrangement of the terminals 26 and timing controls 46, 48, 50 reduces the footprint of the terminal block time delay relay 10, allowing the use of a thin profile (e.g., 6 mm) package.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

I claim:

1. A terminal block time delay relay, comprising:

a terminal block defining a socket operable to receive an electrical relay;

a plurality of terminals accessible at edges of the terminal block;

a first timing control supported by the terminal block;

a timing circuit housed by the terminal block and coupled to the terminals, the first timing control, and the socket.

2. The terminal block time delay relay of claim 1, wherein the first timing control comprises a delay control operable to adjust a delay interval of the timing circuit.

3. The terminal block time delay relay of claim 1, wherein the first timing control is accessible at an edge of the terminal block.

4. The terminal block time delay relay of claim 3, further comprising a second timing control supported by the terminal block and accessible at a side face of the terminal block.

5. The terminal block time delay relay of claim 4, wherein the first timing control comprises a delay control operable to adjust a delay interval of the timing circuit, and the second delay control comprises a mode control operable to select a delay mode of the timing circuit 18.

6. The terminal block time delay relay of claim 4, wherein the first timing control comprises a delay control operable to adjust a delay interval of the timing circuit, and the second delay control comprises a range control operable to control a range for the delay interval.

7. The terminal block time delay relay of claim 1, wherein the terminals include power terminals and output terminals.

8. The terminal block time delay relay of claim 7, wherein the terminals include a trigger terminal.

9. The terminal block time delay relay of claim 7, wherein the output terminals comprise a normally-open terminal and a common terminal.

10. The terminal block time delay relay of claim 7, wherein the output terminals comprise a normally-closed terminal and a common terminal.

11. The terminal block time delay relay of claim 1, wherein the first timing control is operable to transmit light, and the timing circuit is operable to light the first timing control to indicate a status of the terminal block time delay relay.

12. The terminal block time delay relay of claim 11, wherein the status comprises a powered-up status.

13. The terminal block time delay relay of claim 11, wherein the timing circuit is operable to flash the first timing control to indicate a delay event.

14. The terminal block time delay relay of claim 11, wherein the timing circuit includes a light engine and the terminal block supports a light pipe optically communicating between the light engine and the first timing control.

15. The terminal block time delay relay of claim 14, wherein the light engine comprises a light emitting diode.

16. The terminal block time delay relay of claim 1, wherein the electrical relay comprises at least one of an electromechanical relay and a solid state relay.

17. A terminal block time delay relay, comprising:

a terminal block defining a socket;

an electrical relay mounted in the socket;

a plurality of terminals accessible at edges of the terminal block;

a delay control supported by the terminal block and accessible at one of the edges;

a timing control supported by the terminal block and accessible at a side face of the terminal block;

a timing circuit housed by the terminal block and coupled to the terminals, the delay control, the timing control, and the socket.

18. The terminal block time delay relay of claim 17, wherein the timing control comprises one of a mode control and a range control.

19. The terminal block time delay relay of claim 18, wherein the electrical relay comprises a coil and a plurality of contacts.

20. The terminal block time delay relay of claim 19, wherein the terminals include power terminals coupled to the coil and output terminals coupled to the contacts.

21. The terminal block time delay relay of claim 17, wherein the electrical relay is releasably mounted in the socket.

22. The terminal block time delay relay of claim 17, wherein the electrical relay comprises at least one of an electromechanical relay and a solid state relay.

* * * * *